US008641233B2

(12) United States Patent
Rehn

(10) Patent No.: US 8,641,233 B2
(45) Date of Patent: Feb. 4, 2014

(54) LIGHTING DEVICE HAVING LIGHT DIODES

(75) Inventor: Henning Rehn, Berlin (DE)

(73) Assignee: OSRAM GmbH, Munich (DE)

( * ) Notice: Subject to any disclaimer, the term of this patent is extended or adjusted under 35 U.S.C. 154(b) by 81 days.

(21) Appl. No.: 13/388,292

(22) PCT Filed: Jun. 23, 2010

(86) PCT No.: PCT/EP2010/058918

§ 371 (c)(1),
(2), (4) Date: Jan. 31, 2012

(87) PCT Pub. No.: WO2011/012381

PCT Pub. Date: Feb. 3, 2011

(65) Prior Publication Data

US 2012/0127714 A1 May 24, 2012

(30) Foreign Application Priority Data

Jul. 31, 2009 (DE) ..... 10 2009 035 516

(51) Int. Cl.
*F21V 33/00* (2006.01)

(52) U.S. Cl.
USPC ..... 362/249.02; 362/311.02; 362/219; 362/225; 362/240

(58) Field of Classification Search
USPC ..... 362/249.02, 311.02, 218, 219, 225, 362/237, 240, 241, 244, 245, 294
See application file for complete search history.

(56) References Cited

U.S. PATENT DOCUMENTS

| | | | | |
|---|---|---|---|---|
| 7,192,161 | B1 * | 3/2007 | Cleaver et al. | 362/260 |
| 2002/0060526 | A1 | 5/2002 | Timmermans et al. | |
| 2005/0225979 | A1 | 10/2005 | Robertson et al. | |
| 2006/0146531 | A1 * | 7/2006 | Reo et al. | 362/244 |
| 2008/0211429 | A1 | 9/2008 | Saito | |
| 2010/0067225 | A1 * | 3/2010 | Uang et al. | 362/235 |
| 2011/0280010 | A1 * | 11/2011 | Ou et al. | 362/217.02 |
| 2011/0305024 | A1 * | 12/2011 | Chang | 362/294 |

FOREIGN PATENT DOCUMENTS

| | | |
|---|---|---|
| DE | 101 34 975 | 2/2003 |
| DE | 600 37 427 | 2/2009 |
| DE | 20 2009 00378 | 5/2009 |
| EP | 0 171 129 | 2/1986 |
| WO | WO 2009/143047 | 11/2009 |
| WO | WO 2010/136248 | 12/2010 |

* cited by examiner

*Primary Examiner* — Laura Tso
(74) *Attorney, Agent, or Firm* — Cozen O'Connor

(57) ABSTRACT

A lighting device (1, 1') having a tube (2), at least sections of which are transparent, and a plurality of light-emitting diodes (LEDs) (4), the LEDs being arranged within the tube next to one another and parallel to the tube longitudinal axis (L), wherein at least one separate optical means (5, 6; 5', 6') is arranged within the tube (2).

10 Claims, 3 Drawing Sheets

A-B

A-B

LIGHTING DEVICE HAVING LIGHT DIODES

RELATED APPLICATIONS

This is a U.S. national stage of application No. PCT/EP2010/058918, filed on Jun. 23, 2010.

This application claims the priority of German application no. 10 2009 035 516.2 filed Jul. 31, 2009, the entire content of which is hereby incorporated by reference.

FIELD OF THE INVENTION

The invention relates to a tubular lighting device having light-emitting diodes (LEDs).

The term LEDs is in this case understood to mean diodes which emit not only visible light (visible electromagnetic radiation [VIS]; white or colored), but also infrared (IR) or ultraviolet (UV) radiation.

BACKGROUND OF THE INVENTION

The use of LEDs in elongate lighting devices as a substitute for tubular fluorescent lamps is already known from numerous documents. For example, reference is made here to the documents US 2002/060526 A1 and US 2005/225979 A1. In said documents, a plurality of LEDs are arranged on an elongate printed circuit board which, in turn, is arranged in a transparent tube which can be inserted into the lampholder of a conventional tubular fluorescent lamp. Since these LED lamps are designed for general lighting, they are not suitable for specific task lighting requiring specific illuminance distribution.

SUMMARY OF THE INVENTION

One object of the present invention is to provide a tubular lighting device on the basis of light-emitting diodes (LEDs), with the result that a predeterminable illuminance distribution is achieved.

This object is achieved in accordance with one aspect of the invention by a lighting device having a tube, at least sections of which are transparent, and a plurality of light-emitting diodes (LEDs), the LEDs being arranged within the tube next to one another and parallel to the tube longitudinal axis, characterized in that at least one separate optical means is arranged within the tube.

Particularly advantageous configurations are given in the dependent claims.

A significant feature of an embodiment of the invention is providing at least one separate optical means in a tubular lighting device on an LED basis which makes it possible to achieve a desired illuminance distribution, both in the direction of the longitudinal axis of the lighting device and in particular in the planes perpendicular to the longitudinal axis. It is therefore possible in particular also to open up application areas which were previously reserved for so-called aperture lamps, i.e. tubular lamps, for example fluorescent lamps, which emit substantially only in a relatively narrow angular range with a high luminous intensity. Moreover, the tube does not necessarily need to be straight but can also be curved, if this is advantageous for the envisaged application.

The term separate optical means is in this case understood to mean one or more optical elements which are not integrated in the housing of an LED. Nevertheless, however, the invention is also intended to include cases in which the LEDs used themselves already have an optic integrated in the LED housing. According to the invention, the term separate optical means in particular also includes a cylindrical lens which forms the light coming from the LEDs or generally the electromagnetic radiation in respect of the desired illuminance or irradiance distribution. The cylindrical lens may be integral, but may also consist of a plurality of parts, for example in the case of particularly long lighting devices according to the invention.

In order to achieve a sufficiently high irradiance on the surface to be irradiated or on the target object, the cylindrical lens is preferably in the form of a focusing lens. In this case, it has proven to be advantageous for at least that face of the cylindrical lens which is remote from the LEDs to have a convex form and for the curvature of this face to be matched to the curvature of the inner face of the tube wall. This makes it possible to arrange the cylindrical lens in such a way that that face of the cylindrical lens which is remote from the LEDs bears against the inner face of the tube wall. In this way, the cylindrical lens can be arranged within the tube in a particularly space-saving manner. Optionally, by virtue of the use of an immersion, light losses in the transition between the cylindrical lens and the tube wall can be minimized. The cross section of the tube is preferably circular.

Furthermore, it is preferred for the at least one optical means to comprise a reflector, in which the LEDs are arranged. Preferably, the reflector has individual funnel-like depressions for each LED, wherein the respective LED is arranged at the narrow end of the associated funnel-like depressions, i.e. on the reflector base. The reflector can have one or more parts. In a preferred embodiment, the reflector has a plurality of parts, wherein a separate individual reflector element is provided for each LED. In addition to efficient light focusing and shaping, this has the advantage that, if required, LED/reflector modules of different lengths can be realized in a very flexible manner. For this purpose, two or more LEDs, including the respective reflector element, are arranged next to one another on a common elongate mount, depending on the required length for the lighting device. Depending on the requirements as regards the intended use of the lighting device, it may be advantageous to also integrate a cylindrical lens in an elongate LED/reflector/lens module. In this case, the cylindrical lens is arranged on the openings in the reflector elements, arranged in a row, with the LEDs. Finally, two or more LED/reflector modules or LED/reflector/lens modules can also be arranged on a common, further mount, which is then arranged in a matching tube. This mount can also consist of individual parts connected to one another. By virtue of the modular design of the lighting device, it is possible for the individual components or modules to be incorporated or replaced relatively easily.

The LEDs used in a lighting device according to the invention do not all need to emit with the same wavelength. Depending on the application, it may also be advantageous to combine LEDs emitting different light colors or VIS/IR/UV-emitting LEDs, for example.

In particular when using high-power LEDs, it may be advantageous to provide at least one channel, at least in the mount, for passing through a coolant in order to enable active cooling of the LEDs. Alternatively, the heat transfer between the mount and the glass tube inner wall can be facilitated by suitable measures, such as the application of thermally conductive paste. Finally, the interior of the tube can be entirely or partially filled with a liquid in order to effectively distribute the heat of the LEDs and to dissipate this heat via the tube wall.

In order to compensate for tolerances and in order to increase the mechanical stability of the construction, in particular the resistance to vibrations, it is advantageous to introduce one or more sprung elements which press one or more components (mount, cylindrical lenses) against the tube inner wall.

Moreover, the lighting device according to the invention is also suitable for applications in which the medium outside the tube is not the ambient air or another atmosphere, but a liquid. In this case, the optical parameters, for example the focal distance of a focusing lens, need to be designed correspondingly, if appropriate. Such an application is, for example, the lighting of a solar cell in an electrolyte bath with a predetermined illuminance distribution. The aim here is to make the solar cell conductive by virtue of the incidence of light in order to provide the possibility of a current flow and the application of ions from the electrolyte solution. Such a method is already known (see document EP 0 171 129 A2, for example).

BRIEF DESCRIPTION OF THE DRAWINGS

The invention will be explained in more detail below with reference to exemplary embodiments. In the figures.

DETAILED DESCRIPTION OF THE DRAWINGS

Figure 1A:
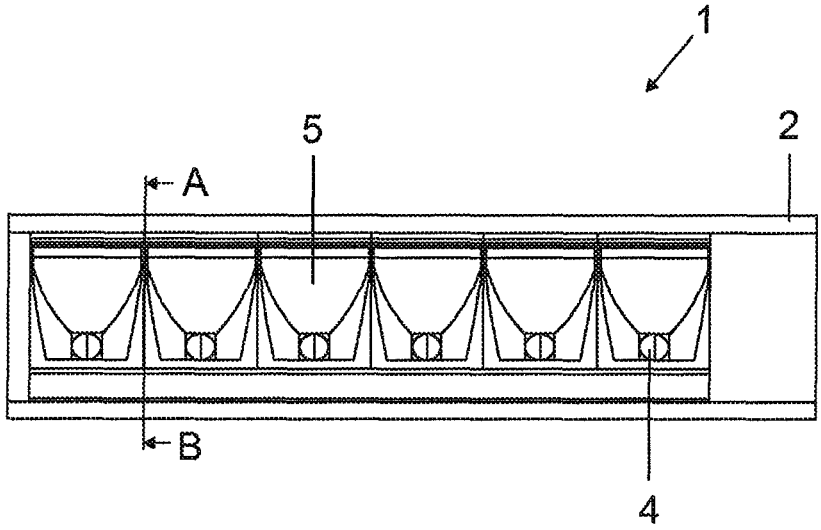
FIG. 1*a* shows a lighting device according to an embodiment of the invention in a plan view.

Identical or similar features are denoted by identical reference numerals in the text which follows.

Figure 1B:
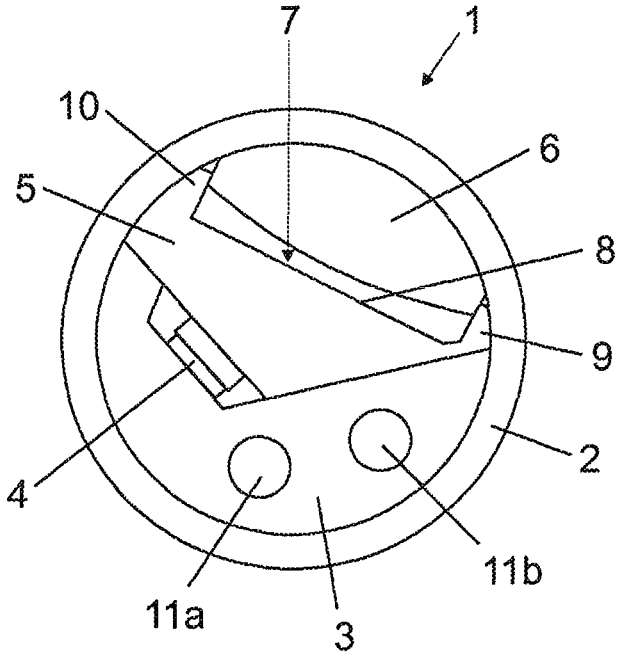
FIG. 1*b* shows a cross-sectional illustration of the lighting device as shown in figure la along the section AB.

FIG. 1*a* shows, schematically, a lighting device 1 according to the invention in a plan view, while FIG. 1*b* shows a cross-sectional view along the line AB. The lighting device 1 is used in particular for lighting extensive areas or objects. In this case, the lighting device 1 and/or the target to be irradiated can also be moved with respect to one another during the irradiation, if required.

The lighting device 1 has a tube 2 consisting of glass, with an elongate metal mount 3, six LEDs 4 of the type Diamond Dragon® or OSTAR® Compact (OSRAM Opto Semiconductors) on a printed circuit board (PCB), six separate reflectors 5, associated individually with the LEDs 4, and an elongate biconvex cylindrical lens 6 consisting of quartz glass being arranged in the interior of said tube. The outer contour of the elongate mount 3 is formed on a first side as a graduated circle, in cross section, in such a way that it nestles into the inner face of the tube 2. On the other side of the mount 3, the six LEDs 4 and the associated six reflectors 5 are mounted in a row in the longitudinal direction. Each reflector 5 has, in plan view, a rectangular basic shape, with an asymmetrical depression 7, which tapers towards the reflector base, starting from a quadrilateral reflector opening rim 8, and ends in a bore, through which the associated LED 4 protrudes. As a result of the asymmetrical design of the reflectors, the lighting device 1 is suitable in particular for surfaces to be irradiated which have a mid-perpendicular which does not point towards the LED/reflector elements 4, 5. The entire surface of the reflectors 5, including the depressions 7, is provided with a reflective coating (not illustrated). The cylindrical focusing lens 6 is surrounded by narrow elevations 9, 10, running on both sides parallel to the longitudinal axis, of the reflectors 5 above the reflector opening rims 8. The curvature of the outer face of the cylindrical focusing lens 6, in the same way as that of the outer sections of the reflectors 5 which are remote from the reflector openings, is matched to the curvature of the inner face of the tube 2. As a result and owing to the relatively compact and tightly pressed design, optimal utilization of the interior of the tube 2 is achieved. For cooling purposes, the mount 3 is provided with two longitudinal bores 11*a*, 11*b* for passing through a liquid coolant.

Figure 2A:
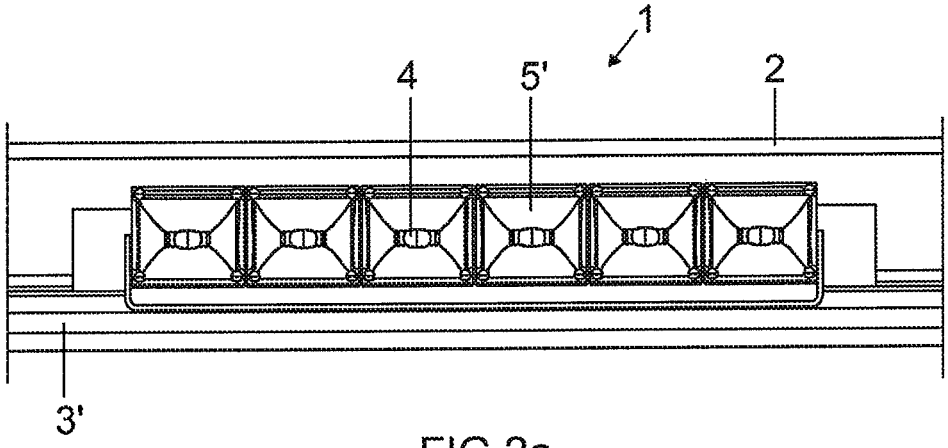
FIG. 2*a* shows a second exemplary embodiment of a lighting device according to the invention.
Figure 2B:
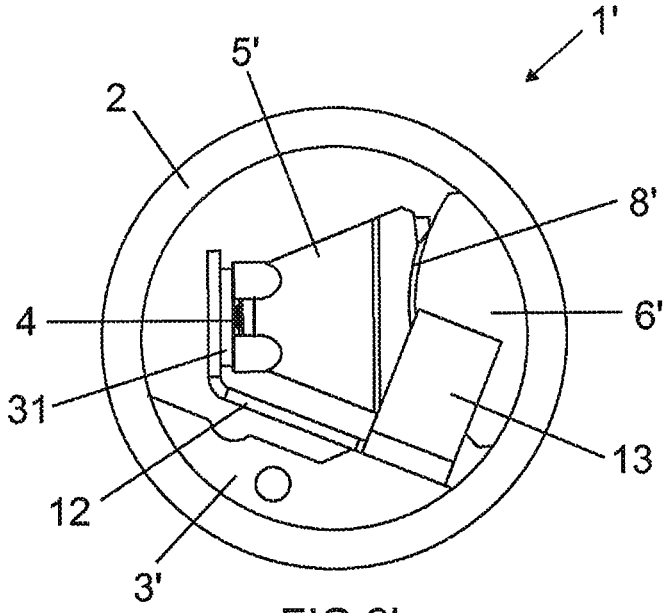
FIG. 2*b* shows an end view of the lighting device shown in FIG. 2*a,*
Figure 3:
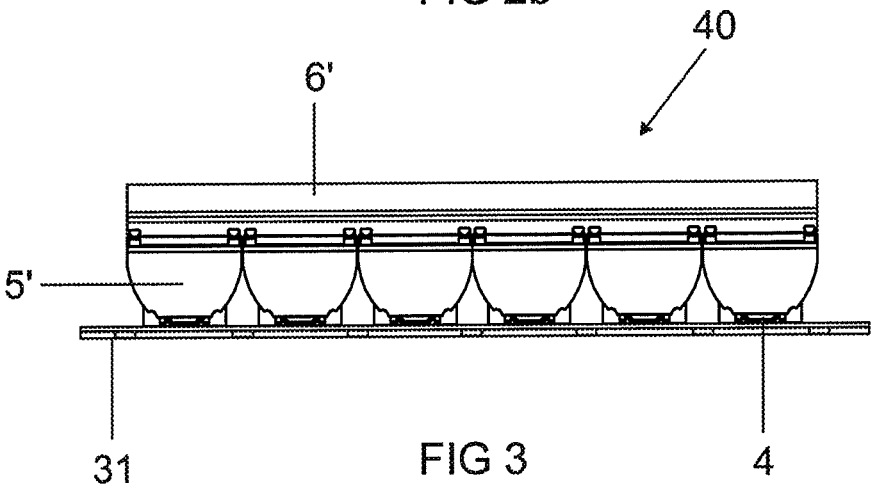
FIG. 3 shows an LED/reflector module of the lighting device shown in FIG. 1*a,*

FIGS. 2*a* and 2*b* show a schematic illustration of a plan view and a cut-away end view, respectively, of a further exemplary embodiment of a lighting device 1' according to the invention. In this case, six LEDs 4, including the associated six reflectors 5', are likewise arranged in a row on a mount 31 in the form of a flat bar and thus form an LED/reflector module 40 (see also FIG. 3). The reflectors 5' are in this case designed symmetrically, in contrast to the first exemplary embodiment. Depending on requirements, such an LED/reflector module 40 can also comprise more or fewer LED/reflector elements 4, 5'. The LED/reflector module 40 is fastened on one side of an elongate mount 3' via an angled rail 12. On the other side, the outer contour of the elongate mount 3' is in the form of a graduated circle, in cross section, and nestles into the inner face of the glass tube 2. Depending on the required length for the lighting device 1', a plurality of LED/reflector modules 40 can also be arranged on the elongate mount 3' (not illustrated). As a result, this modular concept is very flexible if, depending on the application, lighting devices 1' of different lengths are required. An elongate biconvex cylindrical lens 6' is arranged between the reflector opening rims 8' and the inner face of the tube 2. The curvature of the outer face of the cylindrical focusing lens 6' is in this case also matched to the curvature of the inner face of the tube 2. In addition, the contour of the reflector openings 8' is matched to the curvature of the facing face of the cylindrical focusing lens 6'. The cylindrical focusing lens 6' is held at both of its ends with the aid of a retaining plate 13 fitted on the elongate mount 3' (only visible at one end in FIG. 2).

In order to supply electricity to the LEDs, corresponding power supply lines are provided (not illustrated). Furthermore, the driver electronics can be arranged entirely or partially on the PCB. Depending on the application, for example in a liquid, the two ends of the tubular lighting device are sealed in a suitable manner (not illustrated).

Figure 4:
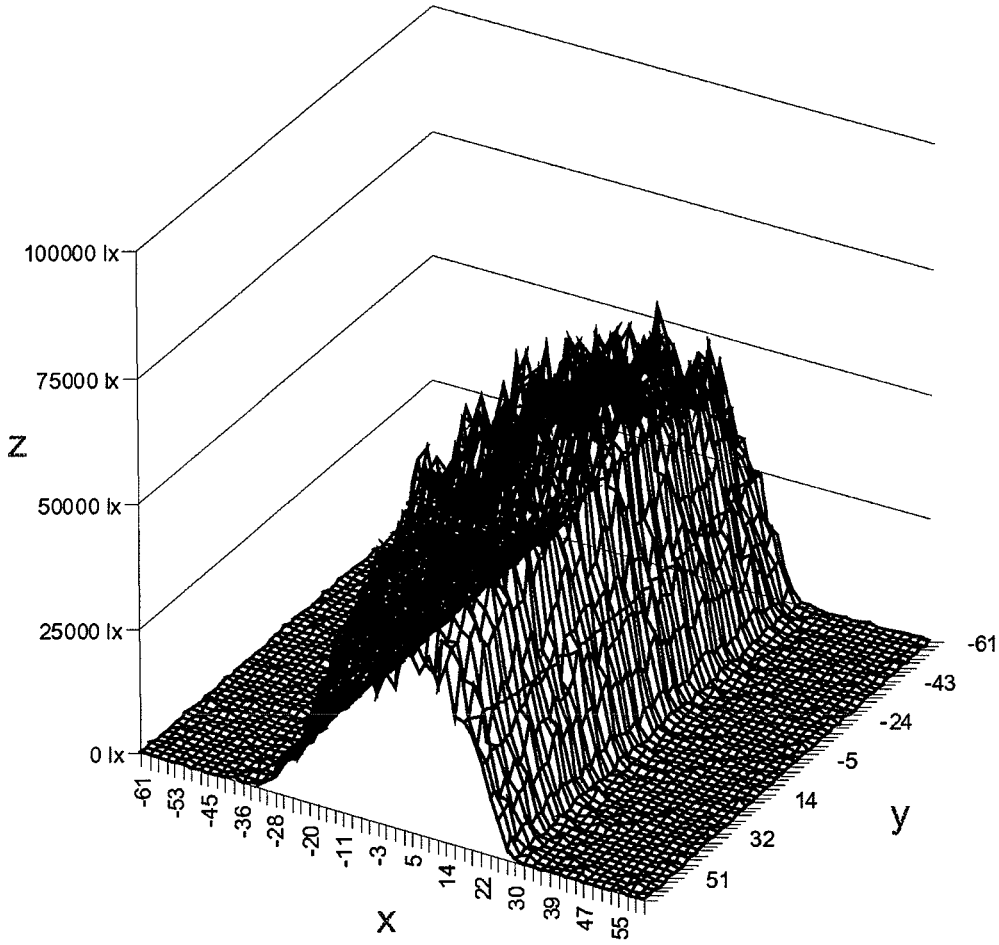
FIG. 4 shows a measured illuminance distribution of the lighting device shown in FIG. 1*a.*

FIG. 4 shows a measured illuminance distribution of the lighting device shown in FIG. 1*a*. The y axis shows the distribution along the longitudinal axis of the tubular lighting device, with the x axis showing the distribution perpendicular thereto. As can clearly be seen, the lighting device produces a virtually rectangular, elongate illuminance distribution with a relatively constant illuminance.

The invention is not limited by the description with reference to the working examples. Instead, the invention encompasses any new feature and any combination of features, which especially includes any combination of features in the claims, even if this feature or this combination itself is not mentioned explicitly in the claims or working examples.

The invention claimed is:

1. A lighting device having a tube, at least sections of which are transparent, and a plurality of light-emitting diodes (LEDs), the LEDs being arranged within the tube next to one another and parallel to the tube longitudinal axis, wherein at least one separate optical means is arranged within the tube, the at least one separate optical means comprises a cylindrical lens, the cylindrical lens is in the form of a focusing lens, and that face of the cylindrical lens which is remote from the LEDs bears against the inner face of the wall of the tube.

2. The lighting device as claimed in claim 1, wherein that face of the cylindrical lens which is remote from the LEDs has a convex shape, and wherein the curvature of this face corresponds to the curvature of the inner face of the wall of the tube.

3. The lighting device as claimed in claim 1, wherein the at least one optical means comprises an elongate reflector, in which the LEDs are arranged.

4. The lighting device as claimed in claim 3, wherein the reflector for each LED has individual funnel-like depressions, and wherein the respective LED is arranged at the narrow end of the associated funnel-like depressions.

5. A lighting device having a tube, at least sections of which are transparent, and a plurality of light-emitting diodes (LEDs), the LEDs being arranged within the tube next to one another and parallel to the tube longitudinal axis, wherein at least one separate optical means is arranged within the tube, wherein the at least one optical means comprises an elongate reflector, in which the LEDs are arranged, wherein the reflector for each LED has individual funnel-like depressions, wherein the respective LED is arranged at the narrow end of the associated funnel-like depressions, and wherein the reflector has a plurality of parts, and wherein a separate individual reflector element is provided for each LED.

6. The lighting device as claimed in claim 3, wherein the cylindrical lens is arranged on an opening in the reflector or reflector elements.

7. The lighting device as claimed in claim 5, wherein two or more LEDs, including the respective reflector element, are arranged next to one another on a common elongate mount in the form of an elongate LED/reflector module.

8. The lighting device as claimed in claim 7, wherein a cylindrical lens is arranged on the openings in the reflector elements in the form of an elongate LED/reflector/lens module.

9. The lighting device as claimed in claim 7, wherein two or more LED/reflector modules or LED/reflector/lens modules are arranged on a common mount.

10. The lighting device as claimed in claim 7, wherein the mount has at least one channel for passing through a coolant.

* * * * *